US012339107B2

(12) United States Patent
Rebar

(10) Patent No.: US 12,339,107 B2
(45) Date of Patent: Jun. 24, 2025

(54) METALLIC, NON-LEADED PROJECTILE FOR MUZZLE-LOADING FIREARMS AND METHODS OF MAKING AND USING THE SAME

(71) Applicant: Peter D. Rebar, Strongsville, OH (US)

(72) Inventor: Peter D. Rebar, Strongsville, OH (US)

( * ) Notice: Subject to any disclaimer, the term of this patent is extended or adjusted under 35 U.S.C. 154(b) by 78 days.

(21) Appl. No.: 17/985,302

(22) Filed: Nov. 11, 2022

(65) Prior Publication Data

US 2023/0152071 A1 May 18, 2023

Related U.S. Application Data

(60) Provisional application No. 63/278,761, filed on Nov. 12, 2021.

(51) Int. Cl.

| | |
|---|---|
| ***F42B 14/00*** | (2006.01) |
| ***F42B 3/00*** | (2006.01) |
| ***F42B 12/02*** | (2006.01) |
| ***F42B 12/74*** | (2006.01) |
| ***F42B 14/02*** | (2006.01) |
| ***F42B 30/02*** | (2006.01) |
| ***F42B 33/00*** | (2006.01) |
| *F41C 9/08* | (2006.01) |

(52) U.S. Cl.

CPC ..... *F42B 14/00* (2013.01); *F42B 12/02* (2013.01); *F42B 12/74* (2013.01); *F42B 14/02* (2013.01); *F42B 30/02* (2013.01); *F42B 33/001* (2013.01); *F41C 9/08* (2013.01)

(58) Field of Classification Search

CPC ..... F42B 6/00; F42B 6/10; F42B 7/10; F42B 8/02; F42B 8/12; F42B 12/00; F42B 12/02; F42B 14/00; F42B 14/02; F42B 30/00; F42B 30/02; F42B 33/00; F42B 33/33001; F42B 12/72; F42B 12/74; F41C 9/08

USPC ..... 86/51, 54, 55; 102/501, 502, 503, 520, 102/524, 526, 527

See application file for complete search history.

(56) References Cited

U.S. PATENT DOCUMENTS

| | | | | |
|---|---|---|---|---|
| 21,924 A | | 10/1858 | Gibbs | |
| 463,840 A | | 11/1891 | Marble | |
| 648,515 A | | 5/1900 | Newell | |
| 3,157,126 A | * | 11/1964 | Gilber | F42B 30/02 102/524 |
| 3,439,620 A | | 4/1969 | Crossley | |
| 3,744,426 A | | 7/1973 | Butler | |
| 3,760,736 A | | 9/1973 | Eig | |

(Continued)

FOREIGN PATENT DOCUMENTS

DE 19814817 A1 * 10/1999 ..... F42B 30/02

OTHER PUBLICATIONS

Machine translation of DE 19814817 A1 (Year: 1999).*

*Primary Examiner* — James S Bergin
(74) *Attorney, Agent, or Firm* — McDonald Hopkins LLC

(57) ABSTRACT

A projectile for muzzle-loading firearms is made completely from a non-lead metal or alloy. It includes a pair of grooves to incorporate O-rings around a circular cylinder. A threaded well may be bored into the forward facing of the cylinder to facilitate insertion and/or removal of the projectile from the barrel via a cooperating ramrod. The projectile is then wrapped in a cloth patch to cover the sidewalls and bottom facing of the cylinder. A method of forming a plurality of the projectiles from standardized bar stock is also contemplated.

15 Claims, 2 Drawing Sheets

(56) References Cited

U.S. PATENT DOCUMENTS

| | | | | | |
|---|---|---|---|---|---|
| 3,910,194 | A | | 10/1975 | Dehm | |
| 4,024,008 | A | | 5/1977 | Gregornik | |
| 4,175,493 | A | | 11/1979 | Daily | |
| 4,353,282 | A | * | 10/1982 | Holt | F42B 14/04 184/14 |
| 4,366,015 | A | | 12/1982 | Murray | |
| 4,417,521 | A | * | 11/1983 | Dahlitz | F42B 14/04 102/511 |
| 4,470,604 | A | * | 9/1984 | Hoffmann | F42B 33/00 273/404 |
| 4,610,205 | A | * | 9/1986 | Bentley | F42B 14/02 102/524 |
| H794 | H | | 7/1990 | Telmo | |
| 5,259,319 | A | * | 11/1993 | Dravecky | F42B 8/10 102/447 |
| 5,415,102 | A | | 5/1995 | White | |
| 5,446,987 | A | * | 9/1995 | Lee | F41C 9/085 42/61 |
| 6,405,654 | B1 | * | 6/2002 | Smith | F42B 12/34 102/501 |
| 7,380,505 | B1 | * | 6/2008 | Shiery | F42B 12/34 102/524 |
| 8,171,852 | B1 | | 5/2012 | Rebar | |
| D683,419 | S | | 5/2013 | Rebar | |
| D739,624 | S | | 9/2015 | Rebar | |
| 9,170,079 | B2 | * | 10/2015 | Moore | F42B 12/42 |
| 2008/0134928 | A1 | | 6/2008 | Shiery | |
| 2017/0167837 | A1 | * | 6/2017 | Goryluk | F42B 33/00 |

* cited by examiner

METALLIC, NON-LEADED PROJECTILE FOR MUZZLE-LOADING FIREARMS AND METHODS OF MAKING AND USING THE SAME

CROSS REFERENCE TO RELATED APPLICATIONS

This application claims priority to U.S. provisional patent application Ser. No. 63/278,761, filed on Nov. 12, 2021, which is incorporated by reference in its entirety.

TECHNICAL FIELD

This application relates to ammunition in the form of projectiles designed for muzzle-loading firearms and, more particularly, to a system relying upon cylindrical, metallic, non-lead projectiles wrapped in a cloth patch and having a pair of compressible O-rings so that the projectile conforms to the barrel of a muzzle-loading firearm, as well as methods of making and using such projectiles.

BACKGROUND

Projectiles and bullets for firearms have been in use for hundreds of years. In operation, a small object is positioned at the closed end of a tubular barrel, with an explosive charge or propellant positioned proximate the object so as to force it out of the barrel at high speed toward a target. In order to improve accuracy, projectiles were typically made from comparatively malleable metals, such as lead, so that the projectile could conform to the barrel (and particularly rifled barrels), thereby causing them to fly along a more true path.

While improvements over the past century or so have enabled the development of self-contained cartridges that can be loaded at the breach or from chambers incorporated proximate to it, muzzle-loading firearms remain popular. Such muzzle-loading weapons require the projectile and a powder charge to be forced down the barrel from the muzzle, so the size and shape of muzzle-loading projectiles, as well as the interfacing surfaces between projectile and the barrel, need to accommodate muzzle-loading and simultaneously insure subsequent discharge of the projectile is reliable and accurate.

Additionally, in comparison to cannons, mortars, and other large guns, the small and portable nature of firearms (i.e., long guns, such as rifles or muskets, and handguns, such as pistols—all of which can be carried, loaded, and discharged easily by a single person) entail additional and unique considerations in comparison to heavy guns. First, owing to their inherent portability, firearms require small projectiles (usually less than 20 mm or .60 caliber in diameter and length that is usually less than 2.5 cm or 1 inch), meaning there are structural limitations to what can be formed/implemented on the projectile itself. Cost and ease of manufacture for the projectiles are also much larger concerns because of the relative ubiquity of small firearms. Also, because projectiles for all firearms are typically not recovered or reused, they should be made from cost-effective, sustainable, and non-toxic materials. In this regard, the use of lead has fallen out of favor, given its ability to contaminate the environment and the target itself (to the extent that target might be wild game intended for human consumption).

Particularly when breech-loading firearms were not as widespread, the preferred ammunition of choice for muzzle-loading firearms and long guns was a simple, round lead ball (sometimes formed by dropping molten lead and allowing it cool and form a sphere as it fell). Lead was preferred owing to its ductility, which permitted the ball to conform to the firearm barrel and/or rifling patterns when the firearm was discharged, while the spherical shapes could be loaded easily down the length of the gun barrel. Lead balls were usually wrapped in paper or other wadding to separate them from the powder/shot charge and facilitate the interface between the ball and the inner surface of the barrel as the ball moved along its length (particularly when entering and also when exiting).

U.S. Pat. Nos. 21,924 and 463,840 disclose patched bullets, although the former was designed specifically for breech-loading firearms. U.S. Pat. No. 7,380,505 describes a muzzle-loading firearm projectile made from copper and having a rear cavity filled with a material of low-density that separates the projectile from the powder charge. A variety of "drive" or "rotary" bands for large artillery shells are also known, such as those in U.S. Pat. Nos. 3,438,620; 3,760,736; 3,910,194; and 4,366,015; however, these cartridge-style shells incorporate a charge and are significantly larger and entail more complex manufacturing and use methods, hardware, and materials, along with larger attendant costs, so as to have little practical value in comparison to the exigencies of smaller, muzzle-loading firearm projectiles.

In view of the foregoing, a simple, easy to make, non-lead projectile for use in muzzle-loading firearms is needed. More particularly, an improved muzzle-loading projectile and system made from common, non-toxic metals that performs comparably to leaded munitions, in terms of conforming to the gun barrel, would be welcome. A method for making such projectiles and using them as part of a broader system are also required.

DESCRIPTION OF THE DRAWINGS

The appended drawings form part of this specification, and any information on/in the drawings is are literally encompassed (i.e., the actual stated values) and relatively encompassed (e.g., ratios for respective dimensions of parts). In the same manner, the comparative positioning and relationship of the components as shown in these drawings, as well as their function, shape, dimensions, and appearance, all inform aspects of the invention so as to be part of this written description. Unless otherwise stated, all dimensions in the drawings are with reference to inches, and any printed information on/in the drawings form part of this written disclosure.

In the drawings and attachments, all of which are incorporated as part of this disclosure.

DESCRIPTION OF INVENTION

Figure 1A:
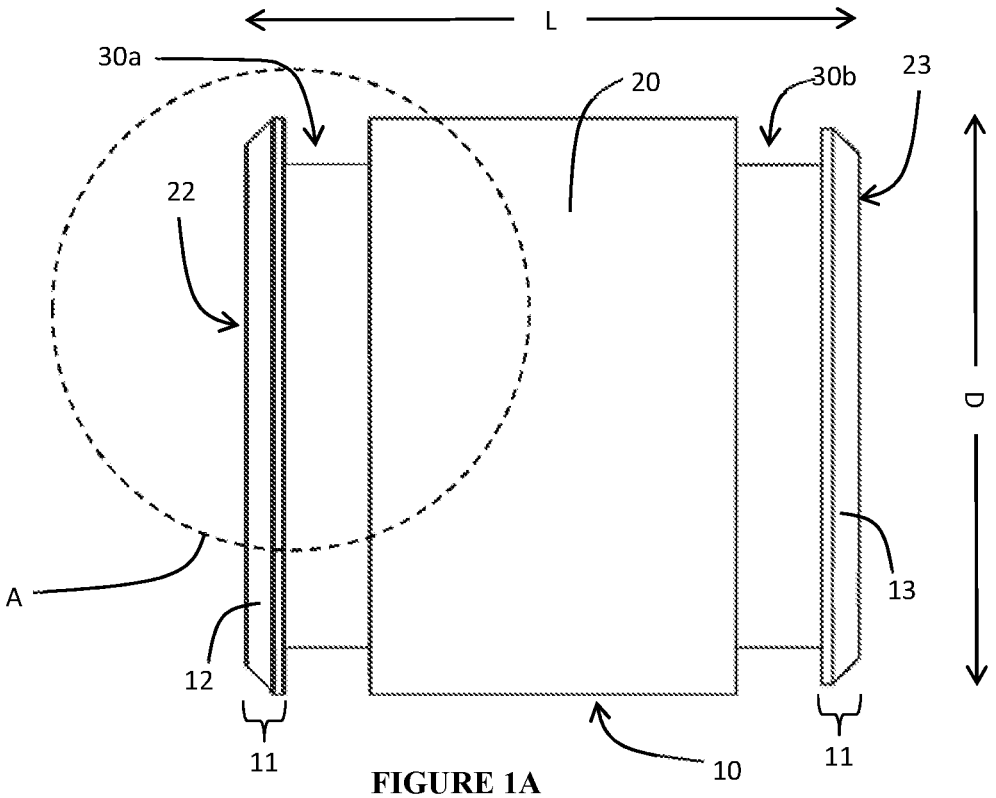
FIG. 1A is a side plan view of the disclosed projectile, without the O-rings, according to various disclosed embodiments.
Figure 1B:
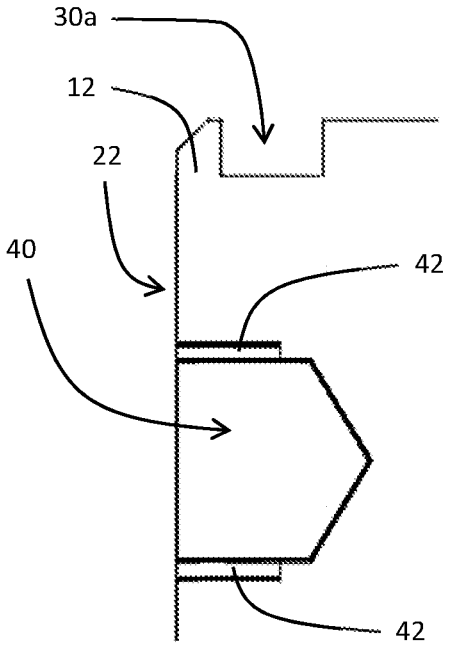
FIG. 1B is an exploded, partial cross sectional view taken along the diameter of callout A in FIG. 1A, illustrating the threaded bore well formed centrally therein.
Figure 2:
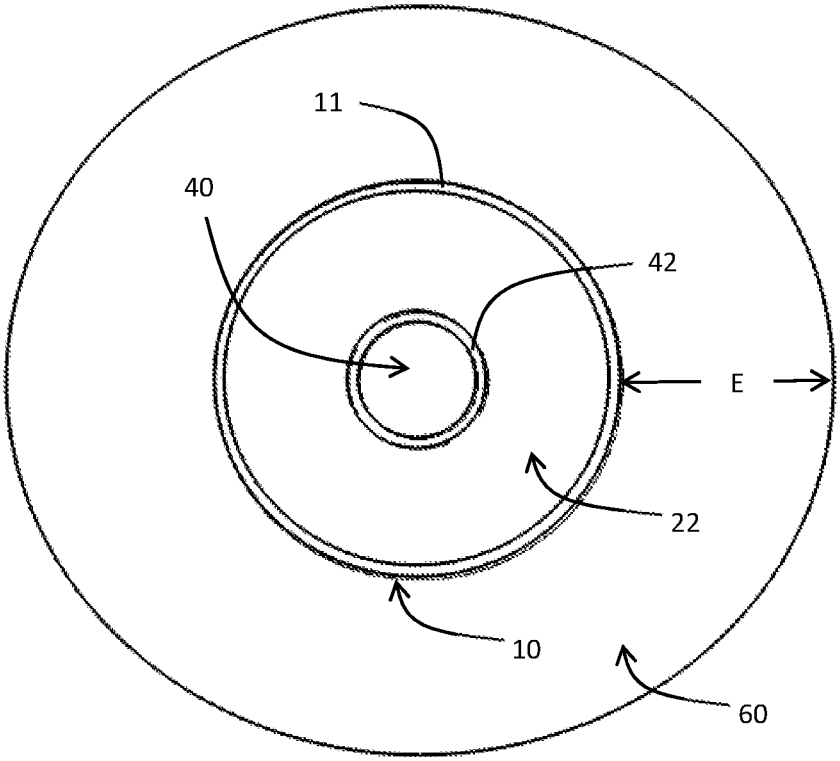
FIG. 2 is a top plan view of the projectile of FIG. 1A, with the cloth patch positioned beneath the projectile.

Operation of the invention may be better understood by reference to the detailed description, drawings, claims, and abstract—all of which form part of this written disclosure. While specific aspects and embodiments are contemplated, it will be understood that persons of skill in this field will be able to adapt and/or substitute certain teachings without departing from the underlying invention. Consequently, this disclosure should not be read as unduly limiting the invention(s).

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Generally speaking, the inventions contemplated herein meet the aforementioned needs by providing a circular, cylindrically shaped body 20 made from non-lead-containing materials, such as steel, copper, aluminium, and various known alloys of any of these metals. For the ease of producing a large number of individual projectiles, it is possible to machine the projectiles from a single piece of bar stock, which is selected based on its diameter and the availability, cost, and compatibility of its composition in regard to the manufacture and use of the projectile. The bar stock diameter should match or be machined or drawn to a size that is compatible with the calibers of muzzle-loading firearms, which is less than 1 inch and, more preferably, less than 0.75 (i.e., .75 caliber) or less than 0.60 inches (0.60 inches). More specifically, projectiles for firearms having muzzles of .45 caliber, .50 caliber, 0.54, and .58 caliber are envisioned.

With reference to FIGS. 1A through 3, the projectile 10 is formed from a cylinder body 20 that is cut to have an axial length L that is approximately equal to or slightly larger than its diameter D, but preferably less than or equal to 110% of that diameter (i.e., for any stated or desired diameter, the appropriate length fall within 100% to 110% of the diameter). In some aspects, the length L will be 0.020 inches greater than the diameter, resulting in preferred lengths of 0.440, 0.490, 0.530, and 0.570 inches (as noted above). A taper or angled section 11 is chamfered at the leading edge 22 and trailing edge 23. The angle of the chamfer may be between 30° and 60°, with 45° being preferred.

A pair of similar or identical grooves 30 are machined into the sidewall of this cylinder. Grooves 30 may include a slight radius (≤0.010 inches) connecting to retention flanges 12, 13 and/or body 20. The depth of the grooves 30 should be between 0.040 and 0.12 inches in comparison to the diameter D in the main body 20, with a depth of 0.070 to 0.010 inches preferred. The diameter D itself should be less than or equal to the caliber of the firearm, usually meaning the bar stock used for the projectile is 0.02 to 0.04 inches smaller than the inner diameter of the firearm barrel.

As preferred but non-limiting examples, a main body 20 has a diameter D of 0.42 inches (appropriate for .45 caliber firearms), while grooved section 30 has a diameter of 0.325 inches adjacent to trailing face 13. Alternatively, a main body diameter D of 0.47 inches would entail diameters for the grooved sections 30 of 0.380 inches; body diameter D of 0.51 inches leads to grooved section diameters of 0.420 inches; and D of 0.55 inches has grooved section diameters of 0.460 inches.

The axial length of each of the grooves 30*a*, 30*b* should be the same, irrespective of the length L, with ranges between 0.060 and 0.100 inches being ideal and a length of 0.080 inches being preferred for both grooves 30. Ultimately, the depth and length of the groove 30 is dictated by the dimensions of the O-rings 50, which are disposed around the projectile 10, as described below.

Each chamfered section 11 is positioned to be on the axially edges, with groove 30*a* is defined by front retention flange 12 and the body 20 and the second groove 30*b* is defined by trailing retention flange 13 and body section 20. Thus, the chamfer section 11 occupies between 0.030 inches and 0.050 inches of total axial length (with 0.035 and 0.040 inches being preferred). In this manner, a leading retention flange 12 and a trailing retention flange 13 are created as part of the chamfered section 11. Usually, a majority of the axial length of the section 11 (and, more preferably about 0.020 inches in all instances) will consist of the tapered/angled portion. In this manner, grooves 30 are offset from the angled section by a straight walled section aligned with the radius of the body 20 and having a radial length of between 0.010 to 0.020 inches (with 0.015 inches being preferred).

The diameter of the trailing retention flange 13 may be further reduced in comparison to that of the leading edge flange 12, preferably by about 0.020 inches. This diameter reduction may occur prior to chamfering the edge 23, meaning that the trailing face 23 will also have a slightly smaller diameter than the corresponding leading face at edge 22. Notably, the axial length and profile of the leading retention flange 12 and trailing retention flange 13, as well as the axial length and radial depth of the groove 30, should remain about the same for all disclosed aspects irrespective of the original diameter D or length L of the body 20, while all other aspects are scaled accordingly. As examples, a body 20 with a diameter D of 0.42 inches would have a flange 13 with a diameter of 0.40 inches that is reduced down to 0.325 inches at its trailing face, while a diameter D of 0.470 inches corresponds to flange 13 diameters of 0.450 inches, D of 0.510 inches to flange 13 diameters of 0.490 inches, and D of 0.550 inches to flange 13 diameter of 0.530 inches. The total axial length of the projectile 10 in all these examples would still be scaled based upon the diameter of the body 20.

Ultimately, the chamfer at edges 22, 23 can be formed when the bar stock is cut, thereby eliminating the need for additional machining. To that end, the cuts in the bar stock can be alternated, with a slightly deeper cut used to form the edge 23 in adjacent pieces, so as to eliminate unnecessary machining (i.e., avoid the aforementioned further reduction in diameter of the flange 13).

A well 40 is bored or formed in the center of the leading edge 22. Threads can be formed along the inner facing 42 of the well, preferably in a 10-32 or similar arrangement. The depth of the well may extend axially beyond the adjacent groove 30, with depth of about 0.10 to 0.14 inches preferred, depending upon the length L of the projectile 10. While a conical facing is illustrated for the well in FIG. 2, it will be understood that the more significant feature relates to the threaded arrangement selected for section 42.

The diameter of the well 40, as well as the particularized thread arrangement (and possibly even the depth of the well 40), are selected to cooperate with a threaded ramrod. In this manner, the projectile may be engaged and forcibly removed from the barrel of the firearm without the need to discharge it by inserting and rotating the ramrod to capture the projectile.

All specific dimensions/values provided in this application (including individual values establishing upper and lower limits of a stated range), should be interpreted in light of significant figures and afforded an additional margin of error of at least +/−0.005 inches. Further, a skilled person may discern comparative ratios and relationships between the stated values in this application, so as to allow for further scaling or the creation of additional limitations as may be appropriate to the circumstances. Any angles stated in this application include an additional margin of error of at least +/−2.5°.

An O-ring 50 made from a non-metallic material is provided in each groove 30. The outer most diameter of the O-ring 50 should at least be flush with and, more preferably, extend slightly beyond the main body diameter D of projectile 10. The material selected for the O-ring will allow it to compress when under pressurized conditions during loading and especially during discharge. In some aspects, the O-rings 50 are made of buna rubber, with the elasticity and resilience of the material—whether buna or some other rubber or polymer—insuring that the O-ring 50 can be easily fitted over the flanges 12, 13 and into the groove 30 without becoming subsequently displaced, except by intentional effort.

The presence of a pair of O-rings 50 protruding slightly beyond the diameter of the sidewall of body 20 allows the projectile 10 to conform and engage the smooth bore and/or rifled surface of the firearm barrel at two separate points. Thus, as the projectile 10 is explosively ejected from the barrel, its flight direction will be dictated by the barrel. In this regard, the O-rings 50 serve as a de facto replacement for the ductility of lead. In this manner, the projectile can be made from the non-lead metals noted above. However, other low cost, readily-available metals and alloys capable of withstanding the explosive conditions in a gun barrel could be employed. Notably, because the O-rings will be made from pliant, resilient material having a lower melting point than the metal/alloy of the projectile, it is believed that the heat generated during discharge of a firearm is sufficient to cause temporary expansion of the O-rings 50 as the projectile 10 travels down the bore, thereby further improving the engagement and interaction between the projectile and gun barrel (i.e., yielding a truer flight based on the shape and direction of the barrel).

In use, the projectile 10 is paired with a cloth patch 60. The diameter of the patch 60 should exceed the diameter D of the projectile 10 by a sufficient amount to "cup" around the sidewall of body 20. Thus, this extra diameter E for the patch 60 correlates to the length L of the body. At a minimum the extra diameter E is sufficient to allow for variation/human error as the user positions the projectile 10 on the patch 60. Conversely, the diameter of patch 60 should not be so large as to constitute a waste of materials.

The thickness of patch 60 is preferably between 0.010 and 0.020 inches. Notably, because the patch 60 is folded or cupped around the entire circumference of the projectile 10, the caliber of the firearm will be equal to the maximum diameter D of the projectile 10 plus two times the thickness of the patch (e.g., for .45 caliber firearm, a diameter D of 0.42 inches and a a patch with a thickness of 0.010 to 0.015 inches are appropriate/required).

Patch 60 may be made of cloth that is soaked or treated with a lubricant or grease so as to facilitate loading and discharging the wrapped projectile. The patch 60 actually comes into contact with the inner barrel (and any rifling provided thereon), while the O-rings 50 provide a further guide and means to keep the projectile 10 aligned during loading and discharge. Further, to the extent the O-rings 50 also compress and conform to the surface of the barrel, the patch 60 insures that the projectile 10 maintains sufficiently uniform and tight fit within the barrel bore. It will be understood that the variations between the diameter D of the projectile 10 and the intended caliber of the firearm, as well as the difference in diameter between the leading retention flange 12 and trailing retention flange 13, are also selected to insure the entire assembly (projectile and cloth) move through the barrel. In some aspects, the patch 60 could be loosely adhered to the trailing end 23 of the projectile 10 (e.g., by a light coating of adhesive) so as to improve the ease of use and allow for the production of a ready-made projectile, although users of muzzle-loading firearms may not deem such attachment as necessary.

Unless noted to the contrary above, the dimensions provided herein may be scaled to the intended caliber of the projectile. These dimensions may also be adjusted to accommodate the particular machining processes and equipment used by the manufacturer. Also, while specific ranges and preferred values are provided for the dimensions, these may be adjusted proportionally according to the diameter and/or length of the body. That is, any ratio or direct or inverse relationship between these specific values should be understood as disclosed and embraced as part of the aspects of invention contemplated herein. Further, any unstated dimensions for a given component can be calculated or discerned based upon the lengths, diameters, and angles for adjacent components that might be provided herein.

Figure 3:
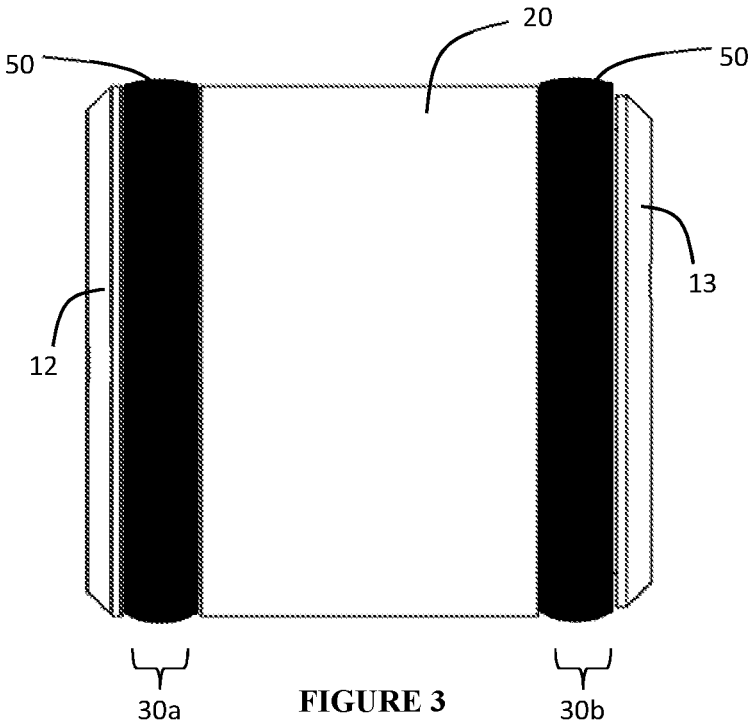
FIG. 3 is a side plan view of the projective of FIG. 1A including the O-rings.

As used herein, axial length refers to the dimensions taken along the axis of the projectile. As such, the axial length will align with the expected direction of travel, with the leading retention flange exiting the barrel of the firearm first. Components and directions identified as radial or transverse will align within a plane that is orthogonal to this axis. Thus, with reference to FIGS. 1A and 3, the axial length of the projectile is visible, whereas FIG. 3 is a radial or transverse point of view.

It will also be understood that the size and dimensions of the projectile 10 are of critical importance. Arbitrary and/or excessive changes to the length or diameter of the projectile will have an impact (usually negative) on the functionality of the projectile itself, in terms of accuracy, repeatability, and the like.

All components and materials selected herein should have sufficient structural integrity, as well as be chemically inert. Common polymers amenable to injection molding, extrusion, or other common forming processes should have particular utility for the O-rings. with grades of nitrile rubber (buna) being particularly advantageous. Preferred metallic bar stock should be machinable without undue wear/damage to equipment, yet be cost effective and readily available for mass production. To that end, all materials, equipment and methods should be selected with an eye toward workability and cost.

In the same manner, engagement may involve coupling or an abutting relationship. These terms, as well as any implicit or explicit reference to coupling, will should be considered in the context in which it is used, and any perceived ambiguity can potentially be resolved by referring to the drawings.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof

What is claimed is:

1. A projectile for muzzle-loaded firearms, the projectile comprising:

a circular cylinder consisting of a single non-lead-containing metal or alloy, wherein a leading retention flange is defined by a first annular groove formed at one end of the circular cylinder and a trailing retention flange is defined by a second annular groove formed at an opposing end of the circular cylinder and wherein the trailing retention flange has a smaller diameter in comparison to a diameter of the leading retention flange; and a pair of non-metallic O-rings, each positioned and configured to fill the first and second annular grooves.

2. The projectile of claim 1 wherein a diameter of the circular cylinder is less than 0.75 inches and an axial length of the circular cylinder exceeds the diameter.

3. The projectile of claim 2 wherein the diameter of the circular cylinder is equal to or greater than 0.35 inches.

4. The projectile of claim 1 wherein the axial length of the circular cylinder is equal to or less than 110% of the diameter of the circular cylinder.

5. The projectile of claim 1 wherein an axial well is formed along a central axis of the circular cylinder at the one end of the circular cylinder.

6. The projectile of claim 5 wherein threads are provided to an inner facing of the axial well.

7. The projectile of claim 1 wherein the leading retention flange has an axial length that is less than an axial length of the first annular groove.

8. The projectile of claim 1 wherein the first and second annular grooves are formed with identical dimensions and positioned at identical distances relative to the one and opposing ends of the circular cylinder.

9. The projectile of claim 1 wherein the leading and trailing retention flanges at, respectively speaking, the one end and the opposing end are chamfered at an angle between 30° and 60°.

10. The projectile of claim 1 further comprising a patch having a diameter greater than the diameter of the circular cylinder.

11. The projectile of claim 10 wherein the patch has a thickness that is selected in combination with the diameter of the cylinder so as to yield a desired caliber for the projectile.

12. The projectile of claim 11 wherein the patch consists of cloth.

13. The projectile of claim 10 herein the patch is provided with lubricant or grease.

14. The projectile of claim 1 wherein the pair of non-metallic O-rings consist of nitrile rubber.

15. The projectile of claim 1 wherein the pair of non-metallic O-rings protrude and extend radially further than the diameter of the circular cylinder.

* * * * *